US008726942B2

(12) United States Patent
Roques

(10) Patent No.: US 8,726,942 B2
(45) Date of Patent: May 20, 2014

(54) STRESS RELIEF IN PRESSURIZED FLUID FLOW SYSTEM

(75) Inventor: Sylvain Roques, London (GB)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 378 days.

(21) Appl. No.: 13/115,207

(22) Filed: May 25, 2011

(65) Prior Publication Data

US 2011/0297256 A1 Dec. 8, 2011

(30) Foreign Application Priority Data

Jun. 3, 2010 (EP) ..... 10164871

(51) Int. Cl.
*F15B 13/00* (2006.01)

(52) U.S. Cl.
USPC ..... 138/177; 408/1 R; 408/16

(58) Field of Classification Search
USPC ..... 138/177, 178, 39; 137/561 R; 408/1 R, 408/16; 239/533.3; 123/456, 468, 469
See application file for complete search history.

(56) References Cited

U.S. PATENT DOCUMENTS

| | | | | |
|---|---|---|---|---|
| 4,819,871 | A | 4/1989 | Kronberger et al. | |
| 5,819,808 | A | 10/1998 | Smith | |
| 6,126,208 | A * | 10/2000 | Asada et al. | 285/133.4 |
| 6,213,095 | B1 | 4/2001 | Asada et al. | |
| 6,263,862 | B1 | 7/2001 | Asada et al. | |
| 6,463,909 | B2 * | 10/2002 | Asada et al. | 123/456 |
| 6,470,856 | B1 * | 10/2002 | Boecking | 123/456 |
| 6,634,335 | B2 * | 10/2003 | Boecking et al. | 123/456 |
| 6,789,528 | B2 * | 9/2004 | Endo | 123/468 |
| 6,923,160 | B2 * | 8/2005 | Wirkowski et al. | 123/456 |
| 7,125,051 | B2 * | 10/2006 | Usui et al. | 285/197 |
| 7,213,577 | B2 * | 5/2007 | Hummel et al. | 123/469 |
| 8,141,910 | B2 * | 3/2012 | Weise et al. | 285/133.3 |
| 8,245,696 | B2 * | 8/2012 | Hofmann et al. | 123/456 |
| 2001/0029929 | A1 | 10/2001 | Natsume | |
| 2002/0112697 | A1 | 8/2002 | Knoedl et al. | |
| 2002/0113150 | A1 | 8/2002 | Boecking et al. | |

FOREIGN PATENT DOCUMENTS

| | | |
|---|---|---|
| CN | 1193690 A | 9/1998 |
| EP | 0 717 227 | 10/2001 |
| EP | 1 340 907 | 9/2003 |

(Continued)

OTHER PUBLICATIONS

European Search Report dated Dec. 17, 2010.

(Continued)

*Primary Examiner* — Paul R Durand
*Assistant Examiner* — Donnell Long
(74) *Attorney, Agent, or Firm* — Mark H. Svoboda

(57) ABSTRACT

A method of reducing tensile stress within a drilled element 100 at an intersection 130 between a primary bore 110 and a secondary bore 120 comprises the following steps. A first face of the drilled element 100 is loaded with a first loading element. A compressive hoop stress is generated where the first face of the drilled element 100 is loaded by the first loading element, and the intersection 130 is sufficiently close to the first face of the drilled element 100 such that the compressive hoop stress counteracts tensile stress in the drilled element 100 at the intersection 130. A suitable drilled element 100 and fluid flow systems, such as a fuel injector, including such a drilled element 100 are also described.

20 Claims, 10 Drawing Sheets

(56) References Cited

FOREIGN PATENT DOCUMENTS

| | | | |
|---|---|---|---|
| GB | 2 335 015 | | 9/1999 |
| JP | 62-101881 | | 5/1987 |
| JP | 10-160079 | A | 6/1998 |
| JP | 2002-310035 | | 10/2002 |
| JP | 2003-527531 | | 9/2003 |
| JP | 2004-27968 | | 1/2004 |
| JP | 2004-138061 | | 5/2004 |

OTHER PUBLICATIONS

English Translation of Japan Office Action dated Dec. 18, 2012.
English Translation of China Office Action dated Feb. 28, 2013.

* cited by examiner

STRESS RELIEF IN PRESSURIZED FLUID FLOW SYSTEM

TECHNICAL FIELD

The invention relates to stress relief in a pressurized fluid flow system, in particular a system in which fluid flows at high pressure through a component bore. The invention is particularly applicable where a component or element with a primary bore requires a secondary bore which has an intersection with the primary bore.

BACKGROUND TO THE INVENTION

High pressure fluid flow systems need to be designed to resist significant operational stresses. An example of such a fluid flow system is a fuel injector for use in the delivery of fuel to a combustion space of an internal combustion engine. For heavy-duty applications, such as fuel injection for diesel engines for trucks, fuel injectors must be capable of delivering fuel in small quantities at very high pressures (of the order of 300 MPa).

Tensile stress is a significant cause of failure in such systems—cracks will be propagated by tensile stress but not by compressive stress. The intersection between two fluid bores has a significant failure risk associated with it in such a system, as it generally acts as a concentrator for tensile stress. In order to reduce the cost of products, it is also desirable to reduce material grade. This would usually reduce material strength, which can increase the failure risk at such intersections.

Such intersections will often be required in a design for a fuel injector. FIG. 1 shows an example of such a component stack used in such a fuel injector design. This fuel injector, discussed in full in European Patent Application No. 09168746.7, is discussed here to illustrate where such intersections may be required in such a design.

FIG. 1 shows a schematic view of a part of a fuel injector for use in delivering fuel to a combustion space of an internal combustion engine. The fuel injector comprises a valve needle 20 (shown in part) and a three way needle control valve (NCV) 10. The injector includes a guide body 12. The NCV 10 is housed within a valve housing 14 and a shim plate 16, which spaces apart the guide body 12 and the valve housing 14.

The valve needle 20 is operable by means of the NCV 10 to control fuel flow into an associated combustion space (not shown) through nozzle outlet openings. The lower part of the valve needle (not shown) terminates in a valve tip which is engageable with a valve needle seat so as to control fuel delivery through the outlet openings into the combustion space. An upper end of the valve needle 20 is located within a control chamber 18 defined within the injector body. This upper end slides within a guide bore 22 in the guide body 12 and acts as a piston. The control chamber 18 has two openings. One, at the top of the control chamber 18, leads to a first axial drilling 42 in the shim plate 16. The other, at the side of the control chamber 18, opens into a flow passage 52 in the guide body 12 that itself leads to a second axial drilling 44 in the shim plate 16. Both these axial drillings 42, 44 connect, through a cross slot 46, to a shim plate chamber 36 used for the NCV 10.

The NCV 10 controls the pressure of fuel within the control chamber 18. The NCV includes a valve pin with an upper guide portion 32*a* and a lower valve head portion 32*b*. The guide portion 32*a* slides within a guide bore 34 defined in a NCV housing 14. The valve head 32*b* slides within the chamber 36 between two valve seats 48, 50. High pressure fuel reaches the NCV 10 through a supply passage 30 extending through the guide body 12 and the shim plate 16, the supply passage 30 communicating with the NCV through a passage entering the guide bore 34 from the side. Fuel can leave the NCV through the cross slot 46 as discussed above or through a drain passage 38 communicating with a low pressure drain.

As previously stated, the NCV 10 controls the pressure in the control chamber 18 and hence movement of the valve needle 20. In one position of the NCV 10, fuel flows through the NCV 10 through the cross slot 46 and into the control chamber 18 to pressurise it, and in another position fuel cannot flow into the control chamber 18 but instead drains from it through to the cross slot 46 and hence to the drain 40. The specific details of this arrangement are described in more detail in European Patent Application No. 09168746.7.

The significance of the FIG. 1 arrangement to the teaching of this specification is that it illustrates the use of cross drillings in high-pressure injector designs. Two separate examples are shown: flow passage 52 is a cross drilling in the guide body 12 into the control chamber 18; and fuel supply 30 flows into guide bore 34 through a cross drilling in the valve housing 14. Both these cross drillings experience cycling between low and very high pressure, and are thus exposed to very high tensile stresses. This creates a significant risk of early component failure through crack propagation.

It is therefore desirable to protect components exposed to high tensile stresses against these stresses, and hence against fatigue limiting component life. The geometry of the intersection may be designed to reduce such stresses, but it is difficult to do this robustly and it will lead to increased production costs (both in machining and in process development). There are also conventional approaches that may be used to reduce net tensile stress by building in residual compressive stresses. Such processes include shot peening (in which a surface is bombarded with shot at a force sufficient to cause plastic deformation) and autofrettage (in which the chamber to be treated is subjected to exceptionally high pressure), but such processes are very expensive, may affect production processes and also may lead to robustness problems.

It is therefore desirable to prevent fatigue failure in regions of very high tensile stress, such as cross drillings into a main bore, without the problems of the prior art as discussed above.

SUMMARY OF THE INVENTION

According to the present invention, there is provided a method of reducing tensile stress within a drilled element at an intersection between a primary bore and a secondary bore, the method comprising: loading the drilled element with a first loading element, wherein the first loading element loads a first face of the drilled element; generating a compressive hoop stress where the first face of the drilled element is loaded by the first loading element, wherein the intersection is sufficiently close to the first face of the drilled element such that the compressive hoop stress counteracts tensile stress in the drilled element at the intersection.

This approach achieves reduction in tensile stress at the failure point without the need for pre-processing steps (such as shot peening and autofrettage) which are expensive and which may also cause robustness issues. The approach taught simply uses loading forces to move the intersection towards a compressive stress regime, which is well tolerated, from a tensile stress regime, which is likely to lead to failure.

In preferred approaches, the loading force provides Poisson effect stress in the stress relief layer which further provides compressive stress in the drilled element at the intersection.

In advantageous approaches, the primary bore extends between the first face and a second face of the drilled element, and the method further comprises loading the second face of the drilled element with a second loading element such that a loading force provides a bending moment in the drilled element which provides compressive stress in the drilled element at the intersection.

In a further aspect, the invention provides a drilled element within a system for pressurised fluid flow, wherein the drilled element has a primary bore and a secondary bore with an intersection therebetween, wherein the primary bore extends from a first face of the drilled element, wherein tensile stress within the drilled element is reduced according to one of the methods described above.

The drilled component may be substantially cylindrical. A ratio of the outer diameter of the drilled element to the diameter of the primary bore may be greater than 5, preferably greater than 8.

In a further aspect, the invention provides a system for pressurised fluid flow comprising a drilled element as indicated above and a first loading element, wherein a stress relief layer is provided between the first face of the drilled element and a corresponding face of the first loading element, whereby loading force is provided to the drilled element from the first loading element through the stress relief layer; whereby the stress relief layer extends underneath at least the intersection between the primary bore and the secondary bore, but does not extend over at least a part of the first face of the drilled element.

In embodiments, the stress relief layer is disposed around and adjacent to the primary bore. In particular arrangements the stress relief layer is integrally formed on the first face of the drilled element.

The stress relief layer may be substantially annular. A ratio of the outer diameter of the stress relief layer to the diameter of the primary bore may be between 2 and 7, particularly between 2.5 and 5, and most particularly between 3 and 4.

The ratio between the distance from the centre of the secondary bore to a face of the stress relief layer adjacent to the first loading element to the diameter of the primary bore may be less than 2, preferably less than 1.

In particular arrangements, the stress relief layer may extend further under the intersection than in another part of the first face. One or more load balancing regions may then be provided between the first face of the drilled element and the corresponding face of the first loading element.

In a further aspect, the invention provides a system for pressurised fluid flow comprising a drilled element as indicated above and a first loading element and a second loading element, wherein a first stress relief layer is provided between the first face of the drilled element and a corresponding face of the first loading element and a second stress relief layer is provided between a second face of the drilled element and a corresponding face of the second loading element, wherein the primary bore extends between the first face and the second face of the drilled element, and whereby a first loading force is provided to the drilled element from the first loading element through the first stress relief layer and whereby a second loading force is provided to the drilled element from the second loading element through the second stress relief layer; whereby the first stress relief layer extends underneath at least the intersection between the primary bore and the secondary bore, but does not extend over at least a part of the first face of the drilled element.

It is preferred that the second stress relief layer is generally disposed further from the primary bore than the first stress relief layer. This combination of loading forces—their application and location—provides a bending moment in the drilled element which provides compressive stress in the drilled element at the intersection. A ratio of the width of the drilled element to the height of the drilled element in such arrangements may be at least 2, preferably at least 4. In particular arrangements where both the stress relief layer and the second stress relief layer are substantially annular, the inner diameter of the second stress relief layer may be greater than the outer diameter of the stress relief layer.

The term "stress relief layer" here is used to describe layers which serve to relieve stress from a part of the drilled component by the mechanisms described. These layers lie between two faces—a face of the drilled element and a face of the loading element—and only cover a part of the relevant faces, which means that the loading force will be transmitted through the stress relief layer. It will of course be appreciated by the person skilled in the art that these layers can in some sense be considered stress concentrators (in that they will lead directly to local compressive stresses), but the term "stress relief layer" is used here in the light of the functional role of these layers.

In some embodiments, the secondary bore is substantially orthogonal to the primary bore. In others, the secondary bore forms an acute angle with the primary bore between the intersection and the stress relief layer.

In particular embodiments, the primary bore is tapered such that when the drilled element is loaded between the first and second loading elements, the loading forces cause the walls of the primary bore to become substantially parallel. The taper in at least part of the primary bore may be at least 0.1%.

In all these arrangements, the system for pressurised fluid flow may be a fuel injector for use with an internal combustion engine.

BRIEF DESCRIPTION OF THE DRAWINGS

The invention will now be described, by way of example only, by reference to the following drawings in which.

DETAILED DESCRIPTION OF PREFERRED EMBODIMENTS

Figure 1:
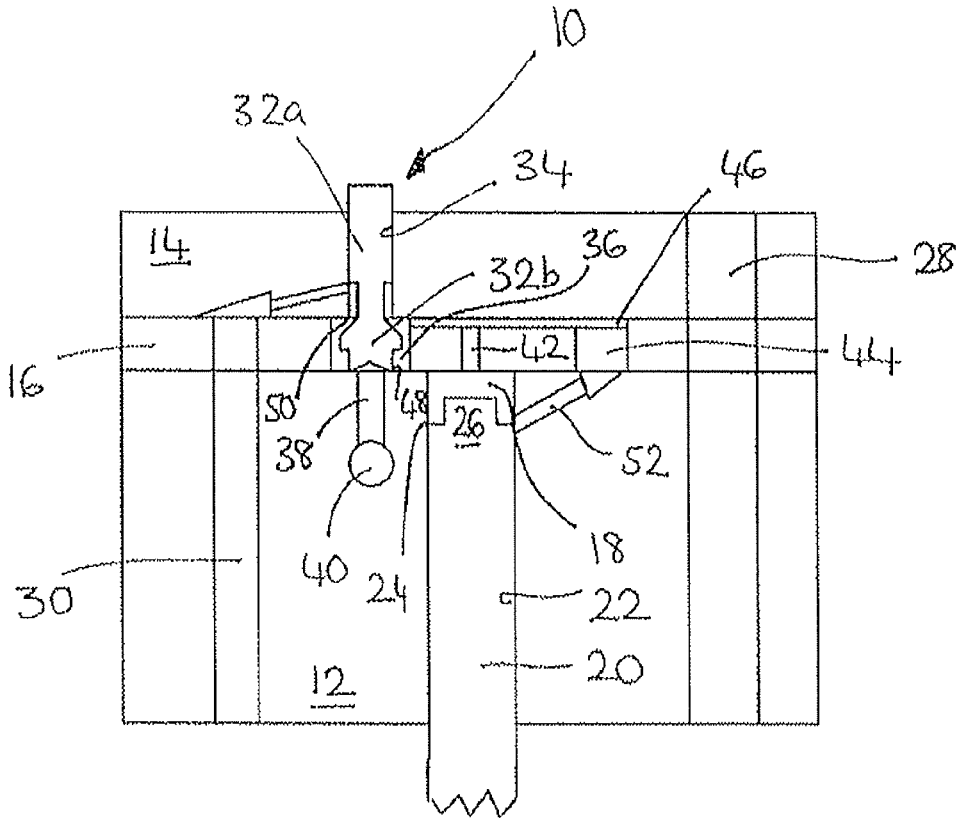
FIG. 1 shows part of a prior art fuel injector in which embodiments of the present invention would be suitable for use.
Figure 2:
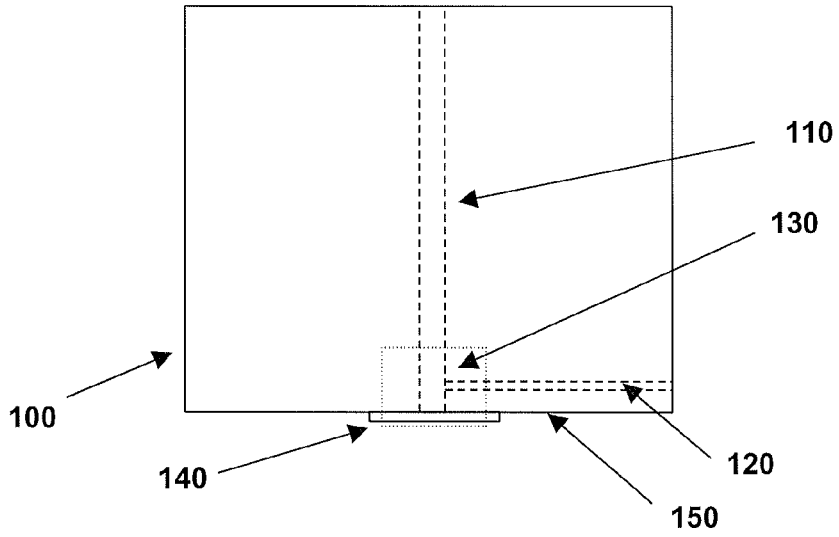
FIG. 2 shows a basic schematic diagram illustrating component elements used in embodiments of the present invention.

FIG. 2 shows elements used in embodiments of the invention. FIG. 2 provides a generalised representation of a component 100 used for high pressure fluid flow. This component 100 is shown here as being radially symmetric about a primary bore 110, though as will be described further below, such radial symmetry need not be provided in all embodiments. The component 100 is in use compressed between other parts in a component stack—these other parts will define a fluid path in to and out of the primary bore 110, and the compression will prevent leakage at the boundary between the component 100 and these other parts, which act as loading elements on the component 100.

The component 100 has a secondary bore 120 that intersects with the primary bore 110 at an intersection 130. In a high pressure fluid flow regime, particularly one which cycles rapidly and repeatedly between high and low pressures, such an intersection 130 will generally be exposed to significant tensile stress unless steps are taken to alleviate this. While this conventionally might be done by shot peening or autofrettage, an alternative approach described here involves the use of a stress relief layer 140, here termed a "face relief", to counteract tensile stress at the intersection 130 with the secondary bore 120. This face relief 140 is located around the primary bore 110 on one face (here, the lower face 150) of the component 100, and at least a part is disposed underneath the intersection 130. A greater part of the lower face 150 has no face relief region, as this only occupies a small proportion of the area of the lower face in the region of the primary bore 110.

It is not unusual to have a face relief region of this general kind in a component for use in a component stack such as that of a fuel injector. The conventional purpose of such a face relief is to concentrate the load provided by the loading element in a small area around a bore in order to prevent fluid leakage—this is known as a sealing contact pressure. What is not conventionally provided is a component design which uses a face relief in such a way as to control tensile stress at an intersection between cores. Such an arrangement is provided here, as will now be discussed with reference to FIGS. 3A to 3D.

Figure 3A:
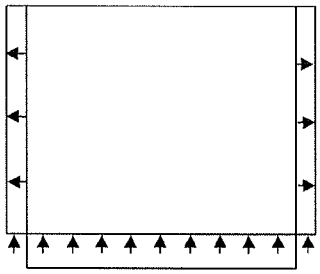
FIGS. 3A to 3D provide a series of diagrams to illustrate the effects of vertical loading in a part of the arrangement shown in FIG. 2.

FIG. 3A shows the effect of loading on a solid component capable of some degree of elastic deformation. The upper part of the component is not shown (it can be assumed that this will be loaded in such a way as to provide a balance of forces). Contact pressure from below, as shown, will result in compression in the vertical direction and consequently lateral expansion according to the Poisson Effect. The degree of expansion (or strain) is a function of the Poisson's ratio of the material and from the geometry of the component. The Poisson's ratio may be determined according to known methods (the Poisson's ration of a typical steel—as might be used in a fuel injector component—is approximately 0.3).

Figure 3B:
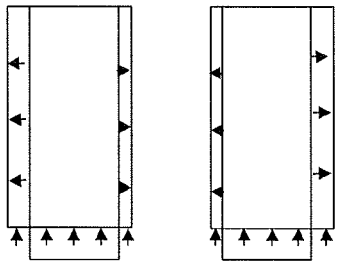

FIG. 3B shows the application of such loading to a component with a central bore, rather than to a solid component. As shown in FIG. 3A, the horizontal deformation resulting from the vertical compression promote expansion of the outer diameter of the loaded component but also contraction of the inner diameter of the central bore.

Figure 3C:
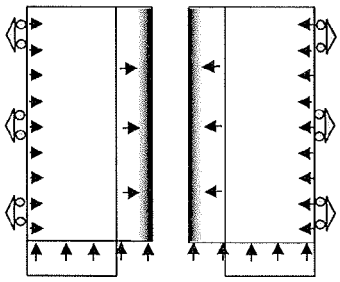

FIG. 3C shows the effect of restraining the radial displacement of the external diameter of the loaded component from above with a much larger component with a much greater outer diameter but a similar central bore—the loaded component shown in FIG. 3C may be considered equivalent to the face relief 140 of FIG. 2, with the much larger component (not shown in FIG. 3C) being equivalent to the bulk part of the component 100. The effect of the much larger component is to fix the outer diameter of the loaded component in position. This means that the radial displacement resulting from the Poisson's ratio of the material may only act on the central bore of the loaded component (which is not pinned by the much larger component, as it also has a central bore). This provides a significant compressive hoop stress. A resulting hoop stress will also be present in the much larger component, though its value will fall away with increased distance from the loaded component.

Figure 3D:
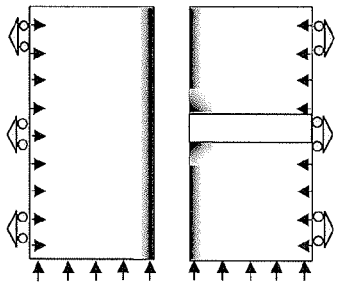

FIG. 3D shows the significance of this arrangement for an intersection with a secondary bore. As discussed above, this is normally a region of increased tensile stress, particularly during pressurised flow. The compressive hoop stress resulting from the Poisson effect is however also present at the intersection point. In fact, if located in a region where this Poisson effect applies strongly the control drilling will act as a stress raiser for this compressive stress (much as it conventionally acts as a tensile stress raiser in a pressurised fluid flow regime).

Figure 4A:
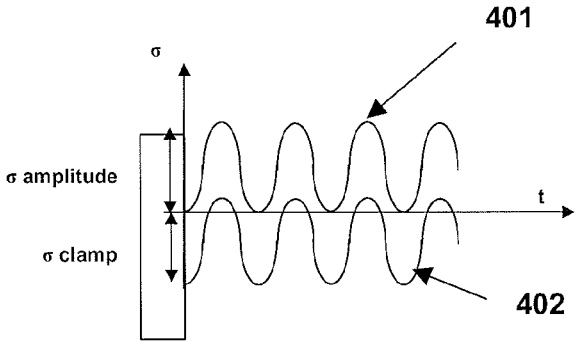
FIGS. 4A and 4B indicate stress regimes for high pressure cycling of a bore and drilling intersection where the effects illustrated in FIG. 3 do, and do not, apply.
Figure 4B:
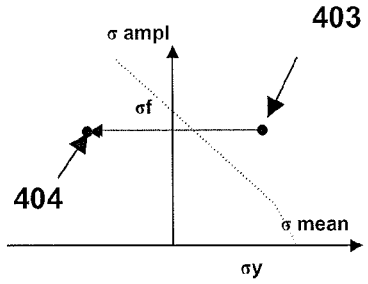

FIG. 4A shows stress against time at the intersection point in a conventional arrangement (line 401) and where the Poisson effect regime of FIG. 3D applies (line 402). Where there is no compressive stress provided by the Poisson effect (or by any other mechanism—an additional mechanism is discussed further below), cycling between high and low pressure leads to repeated very high net tensile stress at the intersection (as shown by line 401). When Poisson effect compressive stress is provided as indicated above, this makes no change to the amplitude of the variations in stress between the high and low pressure regimes, but it does move the baseline strongly into the compressive regime, and hence the stress at peak pressure into the weakly tensile regime (as shown here by line 402—with appropriate design choices the intersection could be kept in the compressive regime at all operating pressures). Components will typically tolerate far higher compressive stresses than tensile stresses, as tensile stresses will cause cracks to open, whereas compressive stresses will hold cracks closed. This is as further shown in the modified Haigh diagram of FIG. 4B—for a given material, its yield stress $\sigma_y$ and fatigue limit $\sigma_f$, operation with uncompensated tensile stress (point 403) is outside the strength criteria envelope (top right area of FIG. 4B), whereas operation with compensated stress (point 404) is well within the strength criteria envelope. As illustrated on the graph, the hoop compressive stresses are reducing the mean stress but keeping the same stress amplitude (moving vertically from point 403 to point 404).

In FIG. 3D, the intersection is shown as lying within the face relief. This is not necessary for the compressive hoop stress to have an effect, as this stress will be translated up into the main component, albeit with significantly diminishing effect the further that the secondary bore, and hence the intersection, lie from the face relief. The size of the face relief is also a significant factor in determining the compressive hoop stress that will be seen at the diameter of the primary bore, and hence at the intersection. These factors are explored qualitatively in FIGS. 5 and 6.

Figure 5:
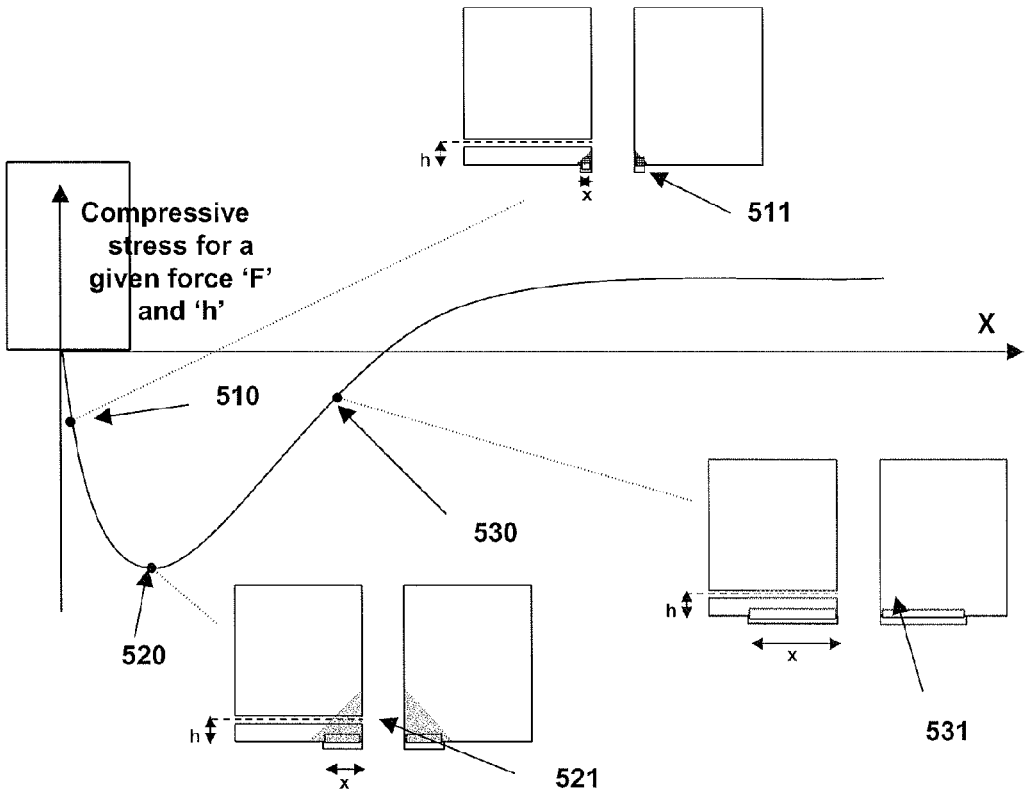
FIG. 5 indicates qualitatively the relationship between face relief size and compressive stress distribution in the arrangement shown in FIG. 2.

FIG. 5 illustrates qualititatively the change in compressive stress seen at the intersection for a given loading force F and cross drilling height h (as shown in FIG. 2) against annular width x of the face relief. Position 510 shows a low resultant compressive hoop stress—as can be seen, the small face relief creates a small region 511 of high compressive hoop stress in the main component, but this region 511 is so small that the intersection between bores lies outside it and the compressive hoop stress seen at the intersection is minimal. Position 520 shows—for this geometry—an optimal compressive hoop stress at the intersection. The compressive hoop stress seen in the stressed region 521 is smaller than for region 511, but the region is significantly larger in size, so the intersection lies well within it. Position 530 again shows an even lower net compressive hoop stress—the face relief is now so large that while the stressed region 531 is large, the compressive hoop stress within this region is minimal.

Figure 6:
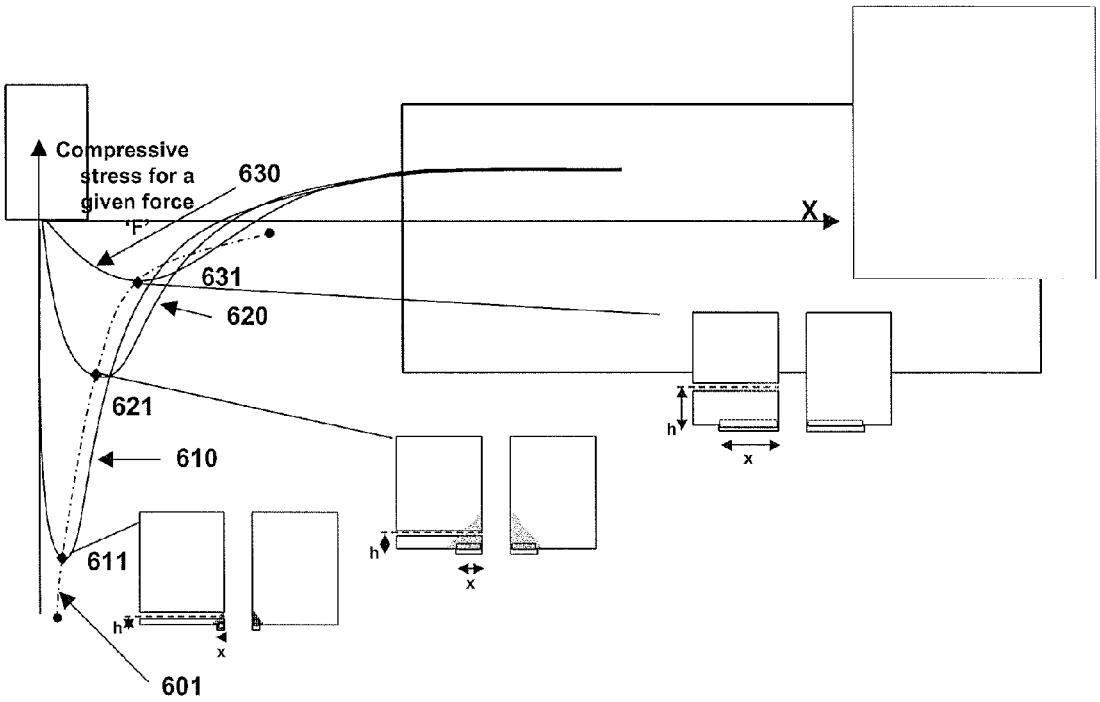
FIG. 6 indicates qualitatively the relationship between face relief size and cross drilling height in the arrangement shown in FIG. 2.

This analysis suggests that it is desirable for the intersection simply to be located as close to the face relief as possible and for the face relief to be as small as possible. This is not in fact the case, as other potential failure mechanisms need to be considered. FIG. 6 shows qualitatively the compressive stress curves for a given force F with varying annular width x, different curves being shown for different intersection heights h. The peak compressive stresses show track through a broadly optimum intersection height to face relief ratio h/x—curve 601 tracks this ratio through the minima of separate stress curves 610, 620 and 630 for different heights. With a small face relief, as shown at position 611 on curve 610, there is very high compressive hoop stress provided, but the extremely small size of the face relief and the extreme proximity of the cross drilling to the face of the component will create other high stresses and hence other major fatigue risks in the design. With a larger face relief, as shown at position 621 on curve 620, there is enough compressive stress generated through the face relief to be effective, and no new fatigue risks are created. With a very large face relief, as shown at position 631 on curve 630, there is simply not enough compressive stress generated by the face relief to be useful.

Figure 7:
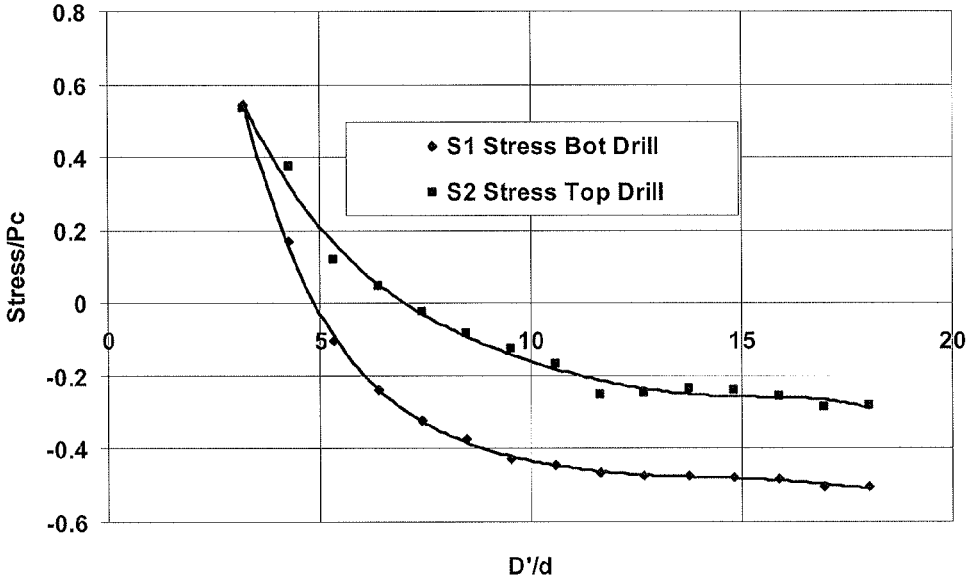
FIG. 7 indicates the effect of changing external diameter relative to internal bore diameter in the arrangement shown in FIG. 2.
Figure 7:
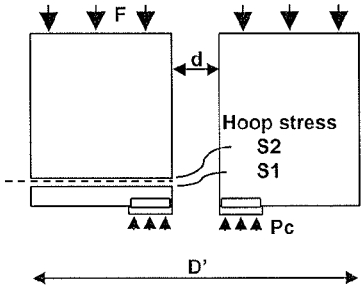
Figure 8:
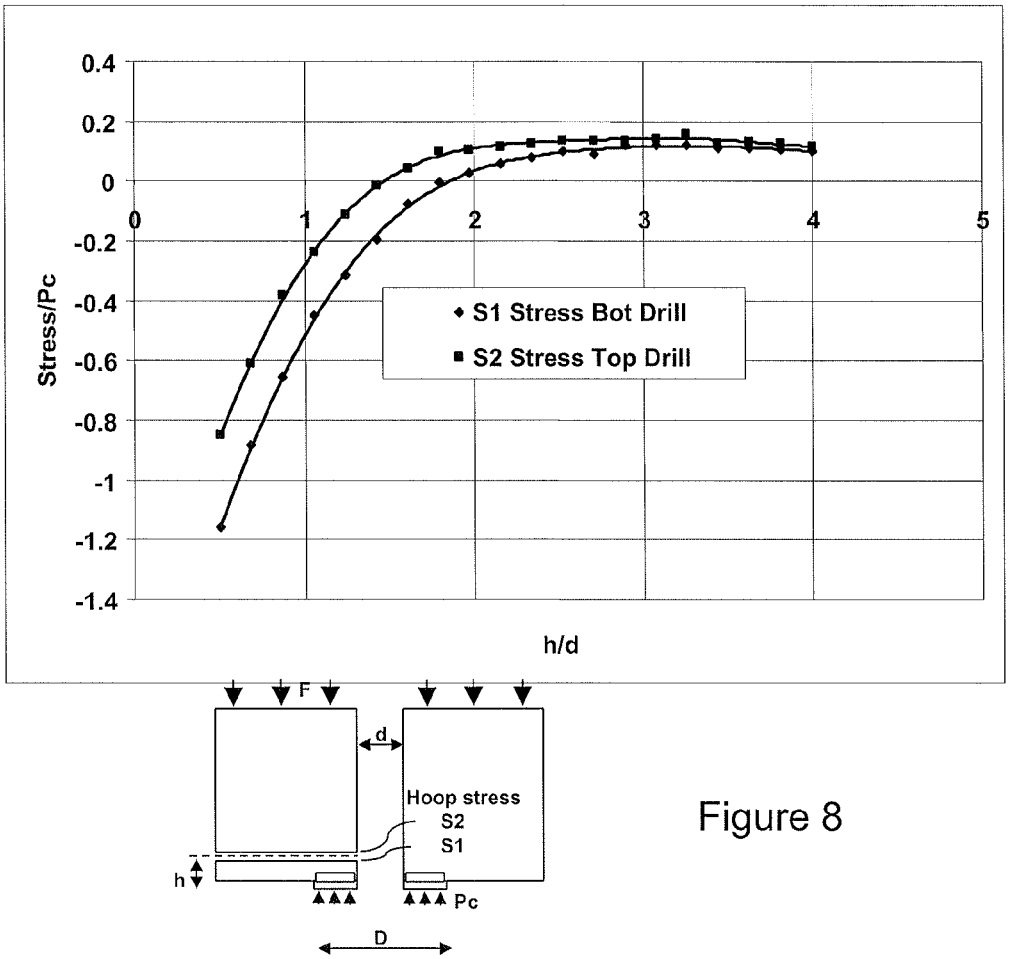
FIG. 8 indicates the effect of changing cross drilling height in the arrangement shown in FIG. 2.
Figure 9:
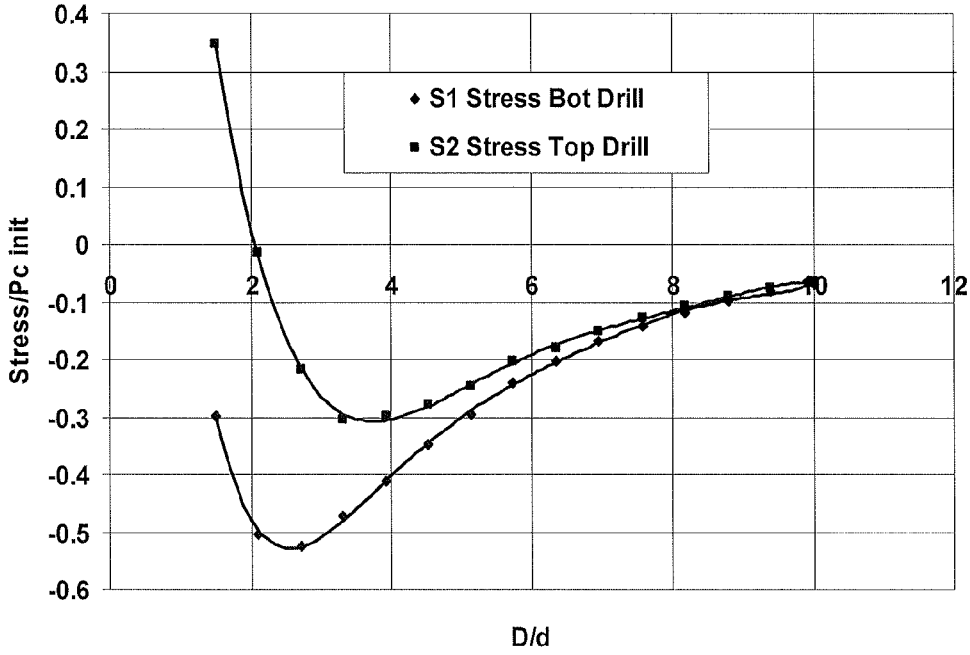
FIG. 9 indicates the effect of changing the size of the face relief in the arrangement shown in FIG. 2.
Figure 9:
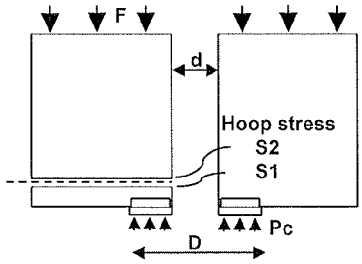

FIGS. 7 to 9 indicate the effect on stress at the intersection of varying certain of the variables shown in FIG. 2 determined by finite element analysis of the system.

FIG. 7 shows the effect of varying the outer diameter D' of the component for a fixed face relief size relative to the diameter d of the primary bore. Where the ratio D'/d is small, there is no useful compressive stress effect—this ratio needs to be at least 5 before the effect becomes useful. This is because if the ratio D'/d is small then the part simply does not have enough bulk to prevent outer diameter deformation as shown in FIG. 3B, that deformation not leading to compressive stress. When the ratio reaches 8, then there is useful compressive stress provided at both the top and bottom of the lateral drilling (and hence also the intersection).

FIG. 8 shows the effect of varying drilling height h for fixed face relief size and component diameters—in this case, the ratio of face relief outer diameter D to primary bore diameter is chosen to be 3. The compressive stress effect begins to be apparent when the value of h/d is reduced to 2, and becomes more significant when this ratio is reduced further. A large compressive stress effect is present when h/d is 1 or lower.

FIG. 9 shows the effect of varying the outer diameter D of the face relief with other component diameters and drilling height h fixed. As indicated previously, too small a face relief provides a great compressive stress concentration but located too low in the component to affect the drilling, whereas too large a face relief provides insufficient compressive stress to relieve the tensile stress at the intersection effectively. In this arrangement, a useful effect is found when D/d lies between 2 and 7, a stronger effect is found when D/d lies between 2.5 and 5, and a very strong effect when D/d lies between 3 and 4.

Figure 10A:
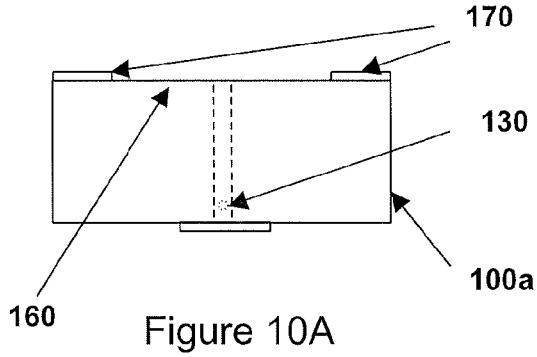
FIGS. 10A to 10C indicates a modification to the arrangement shown in FIG. 2 that illustrates a further aspect of embodiments of the invention.
Figure 10B:
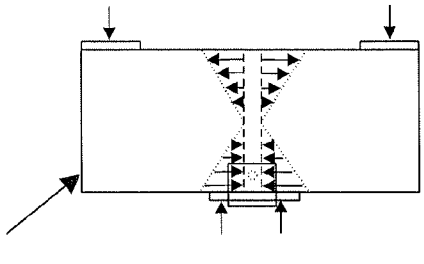
Figure 10C:
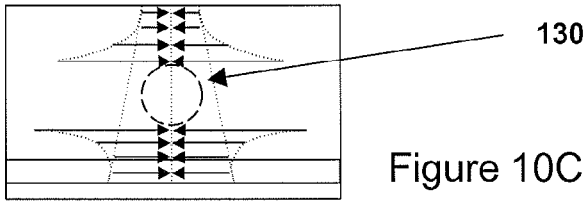

FIGS. 10A to 10C indicate a modification to the arrangement shown in FIG. 2 that illustrates a further aspect of embodiments of the invention. In this arrangement, the component 100*a* is as shown in FIG. 2 but it also has a further face relief 170 on an upper face 160 of the component, as is apparent from FIG. 10A. The upper face relief 170 has a much larger inner and outer diameter than the lower face relief 140. For a relatively thin component 100*a*, this leads to another mechanism for providing compressive stress at the intersection 130.

FIG. 10B indicates the effect of loading the component 100*a* from above and from below. The action of the loading forces through the two face reliefs 140, 170 results in a bending moment in the component 100*a*. As can be seen from FIG. 10B, this bending moment leads to creation of compressive hoop stress in the bore region at the smaller lower face relief 140 and tensile hoop stress in the bore region at the upper face 160 of the component 100*a*. If the component 100*a* is relatively thick in relation to its outer diameter, this effect will be small, but if it is thin, it will be significant. As is shown in FIG. 10C, which shows stresses in the region of the intersection 130, the intersection again acts as a stress concentrator and so a concentrator for the compressive hoop stress resulting from this bending moment.

Figure 11:
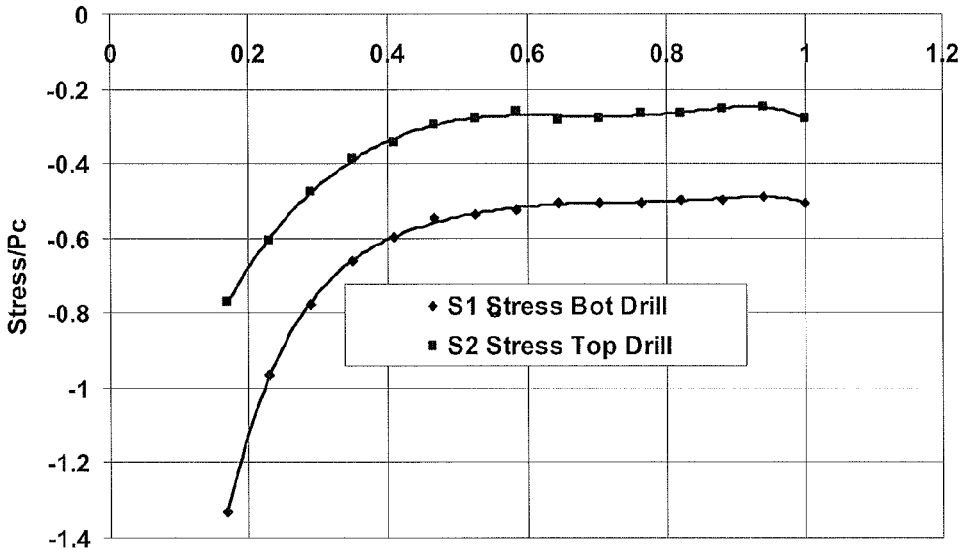
FIG. 11 indicates the effect of changing component height relative to width in the arrangement shown in FIG. 2.
Figure 11:
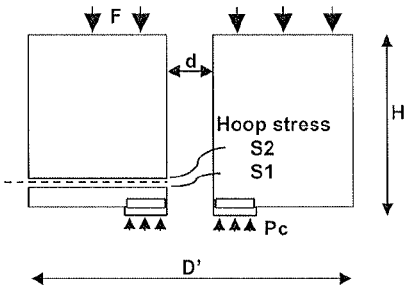

This effect is present for a thin component even without a larger diameter face relief 170 as shown in FIG. 10A. FIG. 11 indicates the variation in stress at the intersection with the ration between component height H and component diameter D' for a given bore diameter d and intersection height h. It can be seen that compressive hoop stress is not present at a significant degree until D'/H is 2 or greater (H/D' is 0.5 or less), but that the effect has become much more significant when D'/H is 4 or greater (H/D' is 0.25 or less).

The Poisson effect compressive stress shown in FIGS. 3A to 3D and the bending moment compressive stress shown in FIGS. 10A to 10C can be used together to build in compressive stress at the intersection 130 in the arrangement of FIG. 2. Either effect may be used on its own to provide a compressive effect at the intersection—while in embodiments shown here the bending moment effect is used primarily to augment the Poisson effect compressive stress, there are arrangements in which it may be valuable on its own.

Figure 12:
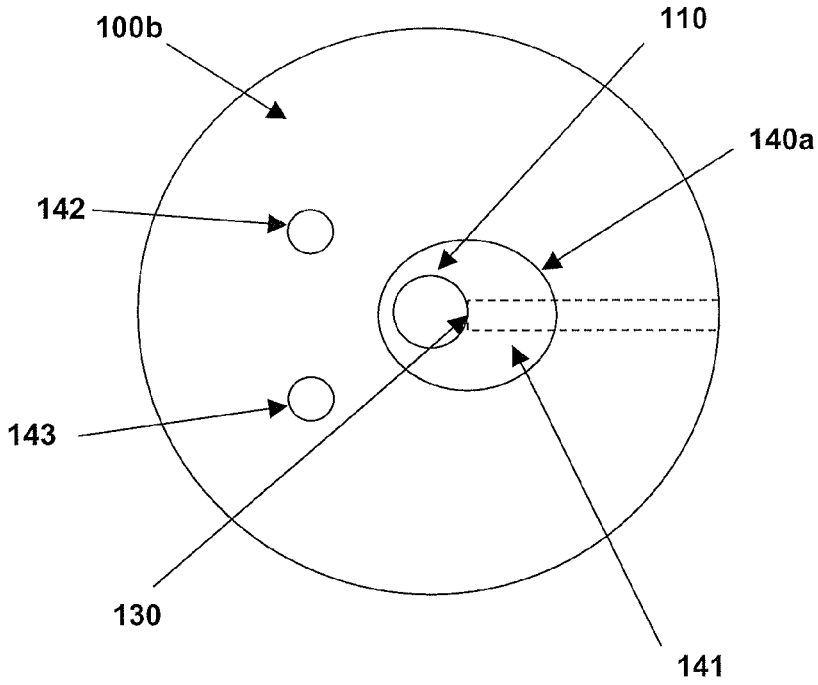
FIG. 12 shows an embodiment of a component with a face relief which is not radially symmetric.

FIG. 12 shows a further embodiment of a component design which uses a face relief to provide compressive hoop stress at an intersection. This component 100*b* is viewed from below, and it can be seen that the face relief 140*a* provided about the primary bore 110 is not axially symmetric. The face relief 140*a* is provided with a larger land 141 underneath the intersection 130 than in other parts of the face relief 140*a*. This radial asymmetry is chosen in order to concentrate compressive hoop stress further in the region of the intersection 130, rather than radially symmetrically around the primary bore 110 (noting that this radial symmetry will already be broken by the stress concentrating effect of the presence of the intersection 130). Some compensation may however be required for having an asymmetric face relief 140*a*, as otherwise the loading force may impart a net turning moment on the component which could lead to a risk of failure or leakage. In consequence, compensatory lands 142 and 143 are provided to balance the effect of the asymmetry of the face relief 140*a*.

Figure 13:
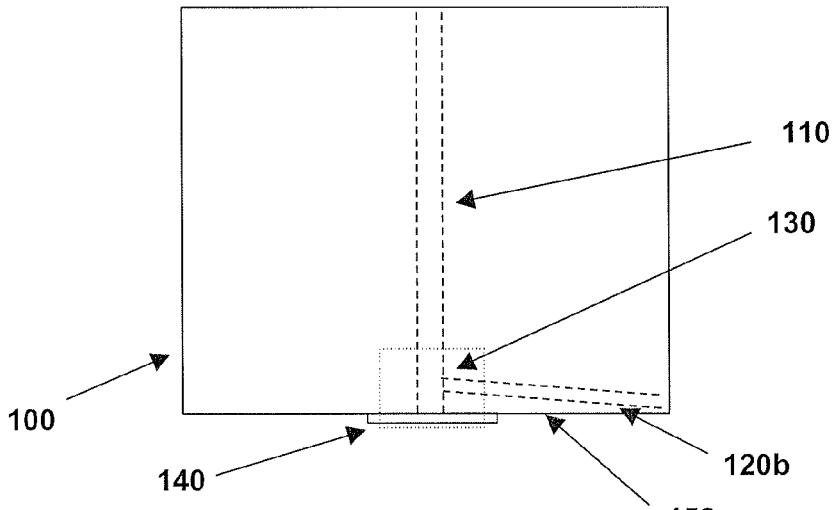
FIG. 13 shows an arrangement similar to that of FIG. 2 but in which the cross drilling is not orthogonal to the primary bore.

A further modification to the arrangement of FIG. 2 is shown in FIG. 13. In this arrangement, the secondary bore 120*b* is not orthogonal to the primary bore 110, but is instead at an angle to it. This may be used to balance the stresses at the intersection, as in this arrangement the lower part of the intersection 130 would normally be more stressed, but as it is closer to the face relief it will also be provided with a greater compressive hoop stress to compensate.

If the face relief is not required to provide a sealing force for fluid flow, more flexibility in design is available. For example, in the arrangement of FIGS. 10A to 10C, the further face relief 170 may not be required to provide a sealing force, and may not need to be an annulus as is shown in FIG. 10A. Alternatively, for example, this face relief 170 may be provided as a plurality of pads disposed symmetrically around the primary bore 110.

Figures 14A, 14B:
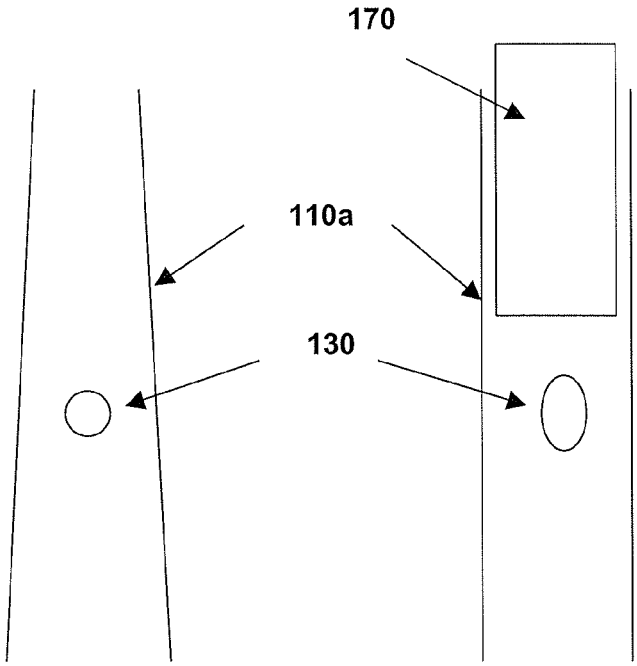
FIGS. 14A and 14B shows an arrangement similar to that of FIG. 2 but with a tapered primary bore, shown unloaded in FIG. 14A and loaded in FIG. 14B.

FIGS. 14A and 14B show a potential modification to the primary bore 110*a* in embodiments of a component using the approaches to stress relief provided above. Many such components will operate with a needle shaped piston 170 reciprocating within the primary bore 110*a*—possibly in such a way as to seal off flow from secondary bore 120 into the primary bore 110*a*. Use of the face relief 140 to generate a compressive hoop stress may lead to some change in shape of the bores. For example, the stresses at the intersection 130 will tend to distort the secondary bore 120 at the intersection 130 into a vertically elongated "rugby ball" shape. In the primary bore 110*a*, the use of compressive hoop stress may lead to a reduction in the diameter of the primary bore 110*a* in the region of the lower face 150 of the component compared to that at the upper face 160 of the component. It is however desirable for the needle shaped piston 170 to be a relatively tight fit within the bore to ensure efficient sealing without leakage. This can be accomplished by providing the primary bore 110*a* with a taper in its unloaded state (shown in FIG. 14A), such that loading, and compressive hoop stress in the region of the intersection 130, will distort the primary bore 110*a* (as shown in FIG. 14B) to one of a substantially constant diameter in the operational range of the piston (ie. a true or parallel bore)—an alternative approach is to taper the piston and not the bore. For the force conditions found within a heavy-duty fuel injector operating under pressures of approximately 300 MPa, the approximate taper in diameter required may be approximately 10 μm over a length of 3 to 5 mm.

Further modifications to these embodiments, and other arrangements falling within the scope of the claims, may be provided by the person skilled in the art following the teaching provided in this specification.

The invention claimed is:

1. A method of reducing tensile stress within a drilled element at an intersection between a primary bore and a secondary bore, the method comprising:

loading the drilled element with a first loading element, wherein the first loading element loads a first face of the drilled element;

generating a compressive hoop stress where the first face of the drilled element is loaded by the first loading element, wherein the intersection is sufficiently close to the first face of the drilled element such that the compressive hoop stress counteracts tensile stress in the drilled element at the intersection.

2. A method as claimed in claim 1, wherein a loading force provides Poisson effect stress in the stress relief layer which further provides compressive stress in the drilled element at the intersection.

3. A method as claimed in claim 1, wherein the primary bore extends between the first face and a second face of the drilled element, and wherein the method further comprises loading the second face of the drilled element with a second loading element such that a loading force provides a bending moment in the drilled element which provides compressive stress in the drilled element at the intersection.

4. A drilled element within a system for pressurised fluid flow, wherein the drilled element has a primary bore and a secondary bore with an intersection therebetween, wherein the primary bore extends from a first face of the drilled element, wherein tensile stress within the drilled element is reduced by loading the drilled element with a first loading element, wherein the first loading element loads a first face of the drilled element, and by generating a compressive hoop stress where the first face of the drilled element is loaded by the first loading element, wherein the intersection is sufficiently close to the first face of the drilled element such that the compressive hoop stress counteracts tensile stress in the drilled element at the intersection.

5. A drilled element as claimed in claim 4, wherein the drilled element is substantially cylindrical.

6. A drilled element as claimed in claim 5, where a ratio of the outer diameter of the drilled element to the diameter of the primary bore is greater than 5.

7. A system for pressurised fluid flow comprising a drilled element as claimed in claim 4 and further comprising a first loading element, wherein a stress relief layer is provided between the first face of the drilled element and a corresponding face of the first loading element, whereby loading force is provided to the drilled element from the first loading element through the stress relief layer;

whereby the stress relief layer extends underneath at least the intersection between the primary bore and the secondary bore, but does not extend over at least a part of the first face of the drilled element.

8. A system as claimed in claim 7, wherein the stress relief layer is disposed around and adjacent to the primary bore.

9. A system as claimed in claim 7, wherein the stress relief layer is integrally formed on the first face of the drilled element.

10. A system as claimed in claim 7, wherein the stress relief layer is substantially annular.

11. A system as claimed in claim 10, wherein a ratio of the outer diameter of the stress relief layer to the diameter of the primary bore is between 2 and 7.

12. A system as claimed in claim 7, wherein a ratio between the distance from the centre of the secondary bore to a face of the stress relief layer adjacent to the first loading element to the diameter of the primary bore is less than 2.

13. A system as claimed in claim 7, wherein the stress relief layer extends further under the intersection than in another part of the first face.

14. A system as claimed in claim 13, wherein one or more load balancing regions are provided between the first face of the drilled element and the corresponding face of the first loading element.

15. A system for pressurised fluid flow comprising a drilled element as claimed in claim 4 and further comprising a first loading element and a second loading element, wherein a first stress relief layer is provided between the first face of the drilled element and a corresponding face of the first loading element and a second stress relief layer is provided between a second face of the drilled element and a corresponding face of the second loading element, wherein the primary bore extends between the first face and the second face of the drilled element, and whereby a first loading force is provided to the drilled element from the first loading element through the first stress relief layer and whereby a second loading force is provided to the drilled element from the second loading element through the second stress relief layer;

whereby the first stress relief layer extends underneath at least the intersection between the primary bore and the secondary bore, but does not extend over at least a part of the first face of the drilled element.

16. A system as claimed in claim 15, wherein the second stress relief layer is generally disposed further from the primary bore than the first stress relief layer.

17. A system as claimed in claim 15, wherein a ratio of the width of the drilled element to the height of the drilled element is at least 2.

18. A system as claimed in claim 15, wherein both the first stress relief layer and the second stress relief layer are substantially annular, and where an inner diameter of the second stress relief layer is greater than an outer diameter of the first stress relief layer.

19. A system as claimed in claim 15, wherein the primary bore is tapered such that when the drilled element is loaded between the first and second loading elements, the loading forces cause the primary bore to become substantially parallel.

20. A fuel injector for use with an internal combustion engine comprising a system as claimed in claim 7.

* * * * *